US005598917A

United States Patent [19]

Thomas

[11] Patent Number: 5,598,917

[45] Date of Patent: Feb. 4, 1997

[54] ELECTRICAL CONTACTOR WITH DETENT

[75] Inventor: Gary R. Thomas, Livonia, Mich.

[73] Assignee: United Technologies Automotive, Inc., Dearborn, Mich.

[21] Appl. No.: 513,244

[22] Filed: Aug. 10, 1995

[51] Int. Cl.[6] ..... H01H 15/02

[52] U.S. Cl. ..... 200/548; 200/503; 200/549; 200/564; 200/565

[58] Field of Search ..... 200/503, 11 TW, 200/548, 549, 550, 551, 547, 564, 565, 16 R

[56] References Cited

U.S. PATENT DOCUMENTS

| | | | |
|---|---|---|---|
| 3,592,982 | 7/1971 | Deltoev | 200/16 R |
| 3,609,257 | 9/1971 | Jinsenji | 200/16 R |
| 3,676,627 | 7/1972 | Happe . | |
| 3,878,344 | 4/1975 | Lockard . | |
| 4,000,383 | 12/1976 | Lockard . | |
| 4,012,608 | 3/1977 | Lockard | 200/550 |
| 4,206,334 | 6/1980 | LaRock . | |
| 4,322,588 | 3/1982 | Chumley | 200/548 |
| 4,366,351 | 12/1982 | Ditzig | 200/551 |
| 4,412,109 | 10/1983 | Schaad et al. . | |
| 4,886,946 | 12/1989 | Franks, Jr. | 200/547 |
| 5,051,549 | 9/1991 | Takano | 200/549 |
| 5,191,971 | 3/1993 | Hakkarainen et al. . | |

*Primary Examiner*—David J. Walczak
*Attorney, Agent, or Firm*—William W. Habelt

[57] ABSTRACT

Disclosed is an electrical contact assembly wherein a conductive contact member for electrically coupling two conductive surfaces also serves as part of a detent assembly. The electrical contact assembly has a contact member resiliently supported by a carrier, wherein the carrier controllably guides the contact member along a path. A feature of the electrical contact assembly is a detent bump disposed at a location along the contact member's path, wherein upon contact between the contact member and the detent bump, the detent bump provides resistance to relative movement between the carrier and the conductive surfaces, thereby producing "detent feel."

12 Claims, 2 Drawing Sheets

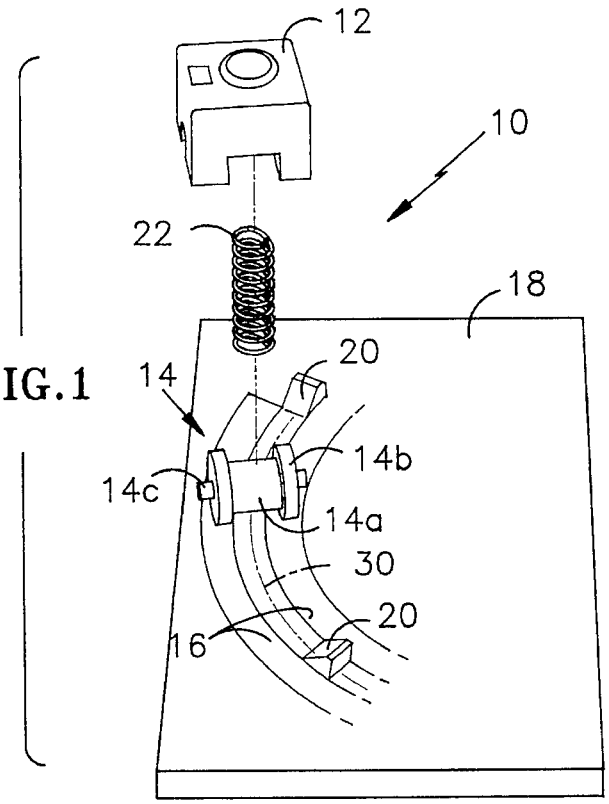
FIG.1
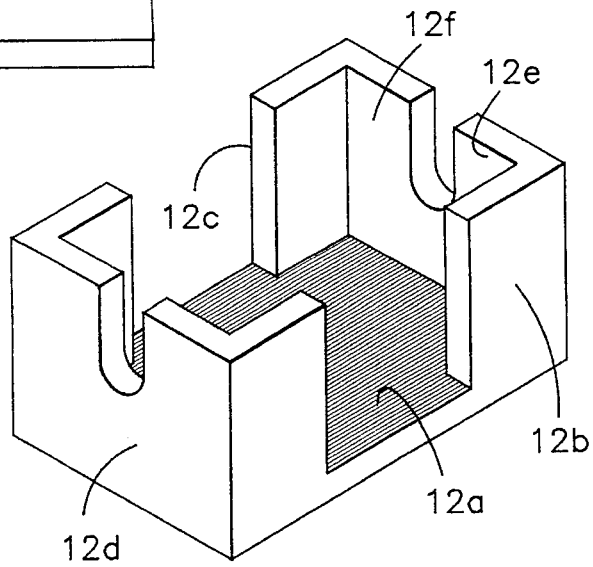
FIG.2
FIG.3
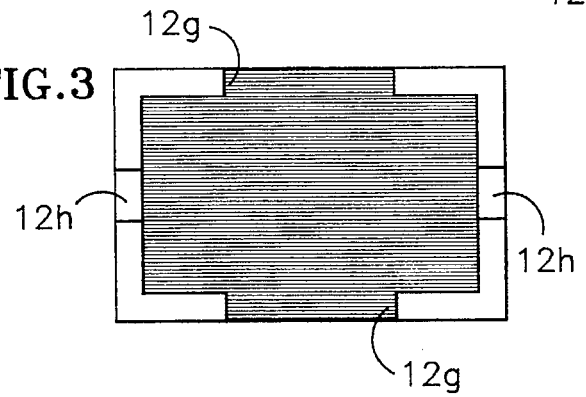
FIG.4
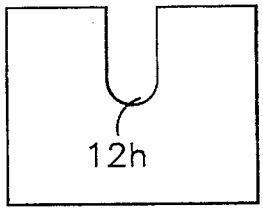

FIG.5
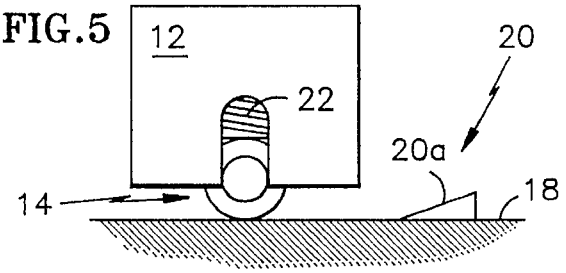
FIG.7
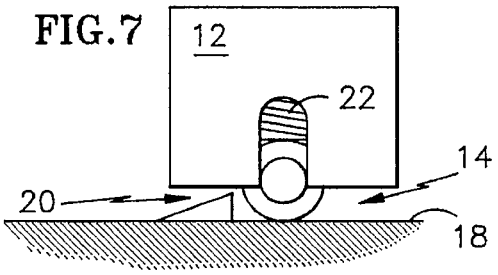
FIG.6
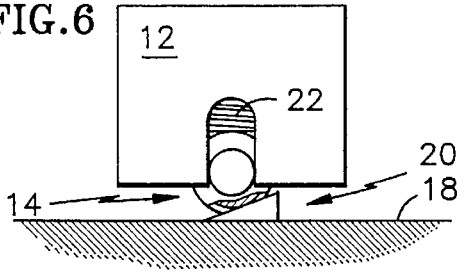
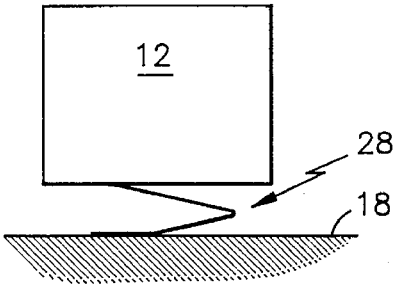
FIG.8
FIG.9
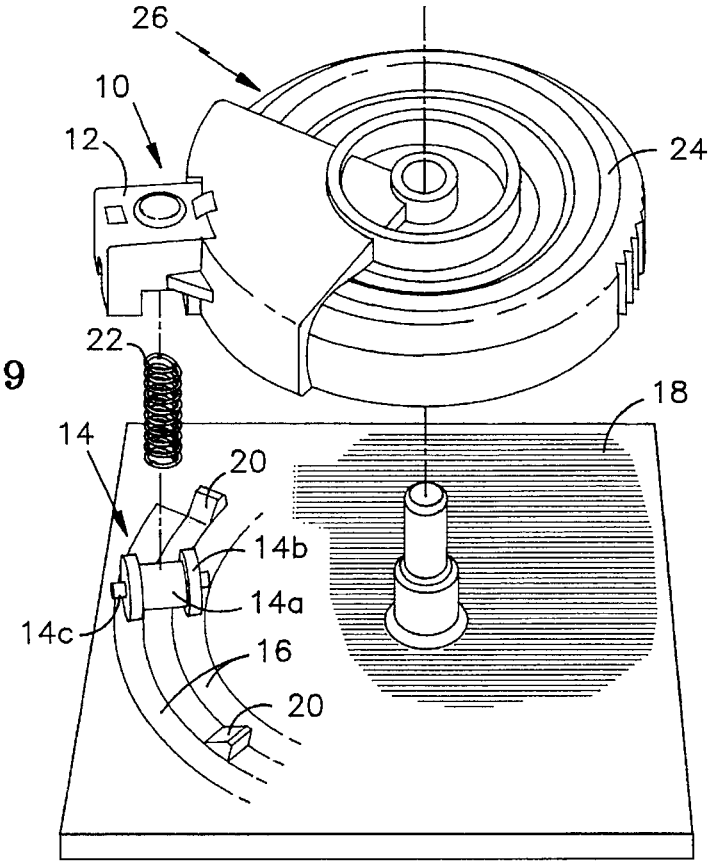

ELECTRICAL CONTACTOR WITH DETENT

TECHNICAL FIELD

This invention relates generally to electrical contacting devices, and more particularly, to an electrical contact assembly wherein a contact member for coupling conductive surfaces also operates to produce detent feel.

BACKGROUND OF THE INVENTION

Electrical contacting devices are used in a number of electro-mechanical applications to make and break electrical circuits. Typically, electrical contacting devices have two conductive surfaces and a contact member formed of a conductive material, wherein at least one of the conductive surfaces is attached to an electrical source. When the contact member is positioned such that it makes contact with both of the conductive surfaces, it electrically couples the two conductive surfaces, thereby making an electrical circuit. Conversely, when the contact member no longer makes contact with both conductive surfaces, then it no longer electrically bridges the conductive surfaces and the circuit is broken.

Electrical contacting devices are commonly used in switches such as a rheostat. In operation, mechanical or electro-mechanical means (e.g. thumbwheels, slides, toggles) are used to move the contact member in and out of contact with both of the conductive surfaces, thereby varying the electrical output of the switch. It is common in the design of switches to slide a contact member along either a linear or arcuate path, wherein the conductive surfaces are disposed at discrete locations along these paths. When the contact member reaches a point in the path where both of the conductive surfaces are disposed such that the contact member makes contact with both conductive surfaces, a circuit is made. It is also typical for some switches to have a stationary contact member, wherein the conductive surfaces translate along a linear or arcuate path, thereby forming electrical circuits in a like manner.

Another common feature in switches is the inclusion of a detent assembly within the switch. The purpose of the detent assembly is to provide a user of the switch with "detent feel," which is either tactile or aural indications of the positioning of the switch. Detent assemblies frequently employ a spring biased finger which moves along a path within the switch upon movement of the electrical contact member, and a wedge-shaped detent bump which is positioned at a location along the finger's path. When the finger makes contact with the detent bump, the finger resiliently retracts, thereby allowing the finger to travel past the detent bump. When the finger clears the detent bump, the resilient nature of the finger snaps the finger back to its initial, unretracted position. To the user of the switch, the contact between the finger and the detent bump produces a resistive force on the contact member that can be tactilely sensed by the user. In addition, when the finger clears the detent bump, the snapping action of the finger produces an aural indicator of the switch's position to the user as well.

Detent assemblies are commonly used to assist the user of the switch to find a discrete position of the switch. For example, a switch using a detent assembly for the purpose of indicating an on or off position would produce "detent feel" only when the switch is either in the "on" position or in the "off" position, and not at any other point. It is common for switches employing detent assemblies to be used when the switch is used as a mode selector. In this application, the switch allows the user of the switch to select various modes, wherein the user will experience "detent feel" as the switch is positioned such that one of the modes is selected.

DISCLOSURE OF THE INVENTION

It is accordingly one object of the present invention to provide an electrical contact assembly having "detent feel."

Another object of the present invention is to provide an electrical contact assembly that incorporates the "detent feel" features into an electrical coupling assembly.

Yet another object of the present invention is to provide an electrical contact assembly having a resiliently biased conductive contact member which interacts with a detent bump to produce "detent feel."

These objects are achieved in the present invention, an electrical contact assembly having a resiliently biased contact member electrically coupling a first conductive surface with a second conductive surface, wherein the contact member also serves as part of a detent assembly.

A feature of the electrical contact assembly is a carrier for controllably guiding the contact member along a path relative to the conductive surfaces.

Another feature of the electrical contact assembly is a detent bump disposed at a location along the contact member's path, wherein upon contact between the contact member and the detent bump, the detent bump provides resistance to relative movement between the carrier and the conductive surfaces.

Still other objects and advantages of the present invention will become readily apparent to those skilled in the art from the following detailed description, wherein only the preferred embodiments of the invention are shown and described, simply by way of illustration of the best mode contemplated of carrying out the invention. As will be realized, the invention is capable of modifications in various respects, all without departing from the invention. Accordingly, the drawings and description are to be regarded as illustrative in nature, and not as restrictive.

BRIEF DESCRIPTION OF THE DRAWINGS

FIG. 1 is a perspective, exploded view of an electrical contact assembly embodying features of the present invention;

FIG. 2 is a perspective view of the carrier depicted in FIG. 1;

FIG. 3 is a top plan view of the carrier depicted in FIG. 2;

FIG. 4 is a side view of the carrier depicted in FIG. 2;

FIG. 5 is side view of the electrical contact assembly of FIG. 1, wherein the carrier is disposed at a location before the detent bump;

FIG. 6 is a side view of the electrical contact assembly of FIG. 1, wherein the carrier is disposed at the same location as the detent bump;

FIG. 7 is a side view of the electrical contact assembly of FIG. 1, wherein the carrier is disposed at a location after the detent bump;

FIG. 8 is an alternative embodiment of the electrical contact assembly; and

FIG. 9 is a perspective, exploded view of a thumbswitch embodying features of the present invention.

BEST MODE FOR CARRYING OUT THE INVENTION

A preferred embodiment of an electrical contact assembly 10 embodying features of the present invention is depicted in FIG. 1. A carrier 12 rotatably supports a contact member 14, which is resiliently biased by, for example a spring 22, towards two conductive surfaces 16 disposed upon a mounting surface 18. A detent bump 20 also disposed on the mounting surface 18, is positioned at a point along a path 30 traveled by the contact member 14 such that it may interact with the contact member 14 to produce "detent feel." The path 30 along which the contact member 14 travels extends on the mounting surface 18 intermediate and proximate the conductive surfaces 16. As the contact member 14 travels along the path 30, a first surface of the contact member 14 may selectively contact one of the conductive surfaces 16 extending along one side of the path 30 and a second surface of the contact member 14 may selectively contact the other of the conductive surfaces 16 extending along the opposite side of the path 30.

In a preferred embodiment as depicted in FIGS. 2, 3, and 4, the carrier 12 has a base portion 12*a*, with four walls 12*b*, 12*c*, 12*d*, 12*e* extending therefrom, thereby forming a recess 12*f* in the carrier 12. The front and rear walls 12*b*, 12*c* of the carrier 12 each have a detent slot 12*g* located in a portion of the front and rear walls 12*b*, 12*c* distal from the base portion 12*a* of the carrier 12. The side walls 12*d*, 12*e* of the carrier 12 each have a contact roller slot 12*h* located in a portion of the side walls 12*d*, 12*e* distal from the base portion 12*a* of the carrier 12. Both the detent slots 12*g* and the contact roller slots 12*h* are oriented such that the open portion of the slots faces a direction away from the base portion 12*a*.

In a preferred embodiment, as depicted in FIG. 1, the contact member 14 comprises a barbell-like roller having a cylindrically-shaped 14*a* and two rollers 14*b*, where the two rollers 14*b* are attached to the shaft 14*a* at symmetrical locations spaced apart from the center of the shaft 14*a* such that the first of the rollers 14*b* may selectively contact the first of the conductive surfaces 16 extending along one side of the path 30 and the second of the rollers 14*b* may selectively contact the second of the conductive surfaces 16 extending along the opposite side of the path 30 as the contact roller 14 travels along the path 30. The ends 14*c* of the shaft 14*a* extend beyond the positions of the rollers 14*b*, such that the ends 14*c* of the shaft also define the ends of the contact roller 14.

Referring again to FIGS. 2, 3, and 4, the contact roller slots 12*h* in the carrier 12 are sized such that they may receive the ends 14*c* of the contact roller shaft 14*a*, while also providing enough clearance about the ends 14*c* of the shaft 14*b* to allow the shaft 14*a* to rotate. The contact roller slots 12*h* have a semicircular cross-section, which helps facilitate smooth rotation of the contact roller 14 upon insertion of the shaft ends 14*c* into the contact roller slots 12*h*.

In a preferred embodiment, as depicted in FIG. 1, a helical spring 22 is interposed between the base 12*a* of the carrier 12 and the shaft 14*a* of the contact-roller 14 so as to resiliently bias the contact roller 14 away from the base 12*a* of the carrier 12. In alternative embodiments of the present invention, the number of springs 22 used to bias the contact roller 14 may be greater than the preferred one spring. In other embodiments, springs other than helical springs may be used to bias the contact roller 14. For example, a leaf spring interposed between the base 12*a* of the carrier 12 and the shaft 14*a* of the contact roller 14 would also provide resilient biasing for the contact roller 14. In some embodiments, the contact roller 14 may be resiliently biased with means other than springs. In these embodiments, elastomeric or other forms of resilient material may be used alone or in combination with springs to provide a similar resilient biasing as found with springs alone.

In operation, the carrier 12 and the mounting surface 18 are spaced apart from each other such that the contact roller 14 is positioned proximal to the mounting surface 18. This positioning ensures that upon relative movement between the carrier 12 and the mounting surface 18, as the carrier 12 moves past a location on the mounting surface 18 where the two conductive surfaces 16 are disposed, the contact roller, 14 will be situated such that it can make contact with the conductive surfaces 16.

There are various embodiments of the present invention for achieving relative movement between the carrier 12 and the mounting surface 18. This relative movement between the carrier 12 and the mounting surface 18 guides the contact member along the path 30 intermediate the conductive surfaces 16. In one embodiment, the mounting surface 18 may be stationary, and the carrier 12 may be capable of movement through conventional means for moving a carrier. For example, the carrier may be moved through the use of a thumbwheel, linear guide, toggle, or any other means known in the art for moving a carrier relative to a mounting surface. In addition, conventional means may be used to just move the contact member relative to the conductive surfaces.

In another embodiment, the carrier 12 may be stationary, and the mounting surface 18 may be capable of movement through conventional means for moving a mounting surface. For example, in this embodiment, a thumbwheel, linear guide, toggle, or any other means known in the art for moving a mounting surface may be used. In addition, conventional means may be used to just move the conductive surfaces relative to the contact member.

In a preferred embodiment, the rollers 14*b* and the portion of the shaft 14*a* located between the rollers 14*b* are formed from a conductive material such that if at least one of the conductive surfaces 16 is connected to an electrical source, then the rollers 14*b* and the portion of the shaft 14*a* located between the rollers 14*b* will all act to electrically couple the two conductive surfaces 16. In alternative embodiments, the contact roller 14 may be formed from a combination of conductive and non-conductive materials or components, such that the rollers 14*b* and the portion of the shaft 14*a* between the rollers 14*b* need not be completely formed from conductive material. However, the composition of the contact roller 14 should still be such that an electric charge can be transmitted from one of the rollers 14*b* to the other roller 14*b*.

In a preferred embodiment, as depicted in FIGS. 1 and 5, the detent bump 20, which is wedge-shaped, is positioned on the mounting surface 18 such that the detent slot 12*g* in the carrier 12 corresponds with the size and position of the detent bump 20, so that as the carrier 12 moves along the path 30 by the location of the detent bump 20, the detent bump 20 will pass through the detent slots 12*g* in the front and back carrier walls 12*b*, 12*c*. The detent bump 20 is oriented at its location such that the ramp portion 20*a* of the detent bump 20 is facing the carrier 12. Therefore, as depicted in FIGS. 5 and 6, the contact roller 14 is biased by the spring 22 into a position within the carrier 12 such that as the carrier 12 passes the location of the detent bump 20, the shaft 14*a* of the contact roller 14 makes contact with the detent bump 20.

Upon contact between the contact roller 14 and the detent bump 20, the wedge-shaped geometry of the detent bump 20 forces the contact roller 14 to deflect away from the mounting surface 18 and towards the base portion 12*a* of the carrier. The spring 22 interposed between the shaft 14*a* of the contact roller 14 and the base portion 12*a* of the carrier 12 provides resistance against this deflection. This resistance to the deflection of the contact roller 14 results in the transmittal of corresponding resistive forces to the carrier 12, thereby providing resistance to the relative movement between the carrier 12 and the mounting surface 18.

The resistance against the deflection action should not be so great as to create resistive forces against the carrier 12 that will prevent the carrier 12 from passing the location of the detent bump 20. The amount of resistance the spring 22 provides against the deflection, and the subsequent resistance the carrier 12 experiences due to this spring 22 resistance may be calibrated through the selection of springs with various compressive strengths, or by varying the slope or shape of the detent bump 20. As depicted in FIG. 7, after the carrier 12 has passed the position of the detent bump 20, the spring 22 acts to snap back the contact roller 14 towards the mounting surface 18, thereby returning the contact roller 14 to a position proximal to the mounting surface 18.

Although in a preferred embodiment, the carrier 12 comprises a base portion 12*a* and four walls 12*a*, 12*b*, 12*c*, 12*d* extending therefrom, in alternative embodiments, the shape and design of the carrier 12 may vary. In these various embodiments, the carrier 12 may be integrated into larger assemblies or structures, may have rounded contours, or may be non-symmetrical in design. In addition, in alternative embodiments, the contact roller 14 may be rotatably supported by the carrier 12 through means other than having the ends 14*c* of the contact roller shaft 14*a* sitting in the contact roller slots 12*h*. In these embodiments, the contact roller 14 may be rotatably supported through the support of any portion of the contact roller 14 by the carrier 12, or by structures attached or supported by the carrier 12. The support structure on the carrier 12 is not limited to the use of slots, and may include slide assemblies, tracks, or any other means known in the art for rotatably supporting a contact roller, while also providing for linear translation of the contact roller within the carrier.

Although in a preferred embodiment, a contact roller 14 is used to electrically couple the conductive surfaces 16, in alternative embodiments, other types of conventional contact members may be used for this purpose. In these embodiments, a conductive or partially conductive plate, rod, member, tube, prong, or connector may be used as the contact member to electrically couple the two conductive surfaces 16. In addition, as depicted in FIG. 8, a spring such as a leaf spring may be used to act both as an alternative to the spring 22, and as an alternative to the contact roller 14. In this embodiment, the contact member is itself resilient, comprising a conductive leaf spring 28 is disposed between the carrier 12 and the mounting surface 18. In this position, the conductive nature of the leaf spring 28 enables the leaf spring to electrically couple the conductive surfaces 16, while the spring characteristics of the leaf spring 28 allows the leaf spring 28 to interact with the detent bump 20 to produce similar interaction between the carrier 12 and the detent bump 20 as found in the preferred embodiment.

In the preferred embodiment, the interaction between the detent bump 20, the contact roller 14, and the carrier 12 delivers the desired "detent feel" of the present invention. This "detent feel" may be further described by way of illustration in a switch embodying features of the present invention. As depicted in FIG. 9, a switch 24 for producing variable electrical output has a thumbwheel 26 rotatably supported on the mounting surface 18. The carrier 12 is fastened to the thumbwheel 26, such that as the thumbwheel 26 rotates, the carrier is urged along an arcuate path. The conductive surfaces 16 are disposed at discrete locations on the mounting surface 18 along the carrier's arcuate path. The detent 20 is disposed upon the mounting surface 18 between the conductive surfaces 16 at a predetermined location along the carrier's arcuate path where it is desirable to produce "detent feel."

In operation, the thumbwheel 26 is rotated through conventional means known in the art for rotating a thumbwheel on a switch. These means may include physical, mechanical, electrical, hydraulic, or any combination thereof. For illustrative purposes, if a person is physically rotating the thumbwheel 26, the carrier 12 and contact roller 14 would move along a path 20 which would be arcuate in shape. At the point where the contact roller 14 makes contact with the detent bump 20, the person would tactily sense the forces exerted on the carrier 12 from the detent bump 20. When the contact roller 14 clears the detent bump 20 and snaps back to a position proximal to the mounting surface 18, the person will hear the snapping action, and also tactily sense the reduction in forces on the carrier 12. The combination of the tactile sensing of the forces on the carrier 12 from the detent bump 20, and the aural indication of the contact roller 14 passing the position of the detent bump 20 produces the "detent feel" that serves as an indicator to the user of the switch's position.

In alternative embodiments, switches other than those utilizing thumbwheels may be used, and still employ features of the present invention. In these embodiments, toggle switches, slide switches, rocker switches, or any other switch known in the art can be used that can produce relative movement between the contact roller 14 and the conductive surfaces 16. In addition, as with the contact assembly 10 alone, the switches may employ various types of contact members, carriers, detents, or resilient support means.

It will be readily seen by one of ordinary skill in the art that the present invention fulfills all the objects set forth above. After reading the foregoing specification, one of ordinary skill will be able to effect various changes, substitutions of equivalents, and various other aspects of the invention as broadly disclosed herein. It is intended that the protection granted herein be limited only by the definition contained in the appended claims and equivalents thereof.

What is claimed is:

1. An electrical contact assembly for electrically coupling a first conductive surface with a second conductive surface, said electrical contact assembly comprising:

(a) a carrier, said carrier being capable of movement along a path intermediate and proximate said first and said second conductive surfaces;

(b) a contact member resiliently supported by said carrier, said contact member being controllably guided by said carrier along said path, said contact member having a first contact surface for contacting said first conductive surface and a second contact surface for contacting said second conductive surface, whereby said contact member electrically couples said first conductive surface with said second conductive surface; and (c) a detent disposed at a location along said path, wherein said detent produces resistance to said relative movement between said carrier and said first and said second conductive surfaces upon contact of said contact member with said detent.

2. An electrical contact assembly as claimed in claim 1, further comprising:

means for resiliently biasing said contact member away from said carrier.

3. An electrical contact assembly as claimed in claim 2, wherein said means for resiliently biasing said contact member away from said carrier comprises a spring interposed between said carrier and said contact member.

4. An electrical contact assembly as claimed in claim 1, wherein said contact member comprises a roller.

5. An electrical contact assembly for electrically coupling a first conductive surface with a second conductive surface, said electrical contact assembly comprising:

(a) a carrier, said carrier being capable of movement along a path extending intermediate and proximate said first and said second conductive surfaces;

(b) a contact member resiliently supported by said carrier, said contact member being controllably guided by said carrier along said path, said contact member having a first contact surface and a second contact surface, said contact member having a first position along said path whereat said first contact surface contacts said first conductive surface and said second contact surface contacts said second conductive surface, thereby electrically coupling said first conductive surface with said second conductive surface when said contact member is in said first position, said contact member having a second position along said path whereat at least one of said first and said second contact surfaces is not in contact with its respective one of said first and said second conductive surfaces; and (c) a detent disposed at a location along said path, wherein said detent urges said contact member from said first position to said second position upon contact between said contact member and said detent, thereby facilitating movement of said carrier past said location of said detent, and wherein said contact between said contact member and said detent produces resistance to said relative movement between said carrier and said first and said second conductive surfaces.

6. An electrical contact assembly as claimed in claim 5, further comprising:

means for resiliently biasing said contact member away from said carrier.

7. An electrical contact assembly as claimed in claim 6, wherein said means for resiliently biasing said contact member away from said carrier comprises a spring interposed between said carrier and said contact member.

8. An electrical contact assembly as claimed in claim 6, wherein said contact member comprises a roller.

9. An electrical switch for providing variable electrical output, said electrical switch comprising:

(a) a mounting surface;

(b) a first conductive surface and a second conductive surface, said first and said second conductive surfaces being disposed upon said mounting surface;

(c) a carrier, said carrier being capable of movement along a path extending intermediate and proximate said first and said second conductive surfaces;

(d) a contact member resiliently supported by said carrier, said contact member being controllably guided by said carrier along said path, said contact member having a first contact surface and a second contact surface, said contact member having a first position along said path whereat said first contact surface contacts said first conductive surface and said second contact surface contacts said second conductive surface, thereby electrically coupling said first conductive surface with said second conductive surface when said contact member is in said first position, said contact member having a second position along said path whereat at least one of said first and said second contact surfaces is not in contact with its respective one of said first and said second conductive surfaces; and (e) a detent disposed at a location along said path, wherein said detent urges said contact member from said first position to said second position upon contact between said contact member and said detent, thereby facilitating movement of said carrier past said location of said detent, and wherein said contact between said contact member and said detent produces resistance to said relative movement between said carrier and said first and said second conductive surfaces.

10. An electrical contact assembly as claimed in claim 9, further comprising:

means for resiliently biasing said contact member away from said carrier.

11. An electrical contact assembly as claimed in claim 10, wherein said means for resiliently biasing said contact member away from said carrier comprises a spring interposed between said carrier and said contact member.

12. An electrical contact assembly as claimed in claim 11, wherein said contact member comprises a roller.

* * * * *